US007575491B1

(12) United States Patent
Martin

(10) Patent No.: US 7,575,491 B1
(45) Date of Patent: Aug. 18, 2009

(54) CONTROLLER FOR AN ELECTRIC PROPULSION SYSTEM FOR WATERCRAFT

(75) Inventor: David V. Martin, Fort Pierce, FL (US)

(73) Assignee: Southern Marine, Inc., Stuart, FL (US)

( * ) Notice: Subject to any disclaimer, the term of this patent is extended or adjusted under 35 U.S.C. 154(b) by 1 day.

(21) Appl. No.: 11/736,659

(22) Filed: Apr. 18, 2007

(51) Int. Cl.
*B63H 21/21* (2006.01)

(52) U.S. Cl. ..... 440/87; 440/6; 440/84

(58) Field of Classification Search ..... 440/6, 440/40, 41, 84, 87; 114/150, 151
See application file for complete search history.

(56) References Cited

U.S. PATENT DOCUMENTS 3,940,674 A * 2/1976 Gill ..... 318/589
4,626,757 A * 12/1986 Granchelli ..... 318/588
5,090,929 A * 2/1992 Rieben ..... 440/40
6,234,853 B1 * 5/2001 Lanyi et al. ..... 440/53
6,855,020 B2 * 2/2005 Kaji ..... 440/84
7,037,150 B2 * 5/2006 Morvillo ..... 440/40
7,267,068 B2 * 9/2007 Bradley et al. ..... 114/144 R

* cited by examiner

*Primary Examiner*—Lars A Olson
(74) *Attorney, Agent, or Firm*—Malin Haley DiMaggio Bowen & Lhota, P.A.

(57) ABSTRACT

A controller for an electric propulsion system for watercraft that provides for speed, steering and direction of propulsion with a single stick mechanism. The position of the joystick handle relative to the center position will define speed (deflection from center position), steering (angle position of the deflection relative to the stick access), and propulsion direction based upon the quadrant deflection in the angular position and the angle position of that deflection. The present control system includes an all electric wire connection between the controller and the electric motors eliminating any mechanical connections.

8 Claims, 4 Drawing Sheets

CONTROLLER FOR AN ELECTRIC PROPULSION SYSTEM FOR WATERCRAFT

BACKGROUND OF THE INVENTION

1. Field of the Invention

This invention relates generally to a controller for a pair of electric motors and, specifically, to a manually-activated controller for two electric motors, acting together, used to propel watercraft for controlling speed, steering and direction of propulsion (forward or reverse) of the watercraft.

2. Description of Related Art

Electric boat trolling motors with propellers have been used on watercraft for fishermen to provide steering and speed of the craft. Using trolling motors, a fisherman often controls these propulsion units with a foot pedal for left or right boat movement. Many prior art controllers used mechanical linkage between the actuating member and the electric motor. Some prior art devices also accomplished steering and speed control via electronically signaling. Typically, these devices have had a separate control mechanism for each individual task for steering, speed and forward or reverse direction. For example, an actuating foot pedal is manually rocked back and forth to control steering while a separate speed knob is used to provide for speed control (speed up and speed down). Another speed controller uses speed up and speed down buttons. Finally, a separate button or switch is provided to change propulsion directions from forward to reverse.

The controller and propulsion units described herein eliminate the problems of multiple control devices by providing a single manual controller in the form of a joystick that can adjust speed, steering and direction propulsion for two electric motors acting together used on a watercraft.

Some prior art boat propulsion control systems for electrical motors include a kill switch or commonly referred to as a "dead man" switch. Using the controller described herein, the manually controlled joystick mechanically returns to a center "off" position when the stick is released. Because the joystick center position represents "off" for the motors, if a driver were to fall off the watercraft, the entire propulsion system would turn off.

SUMMARY OF THE INVENTION

An electric propulsion system for watercraft using two digital electric motors and a single joystick controller that controls speed, steering and direction, i.e. forward or reverse, of the watercraft using the two electric propulsion motors. Both electric motors are mounted on a watercraft for propelling the watercraft. The manual controller will be referred to herein after as a joystick or stick controller and includes a manual actuator connected to electrical circuitry that provides output signals described in greater detail below.

The propulsion system and controller described herein has two different embodiments. In the first embodiment, the propulsion system is comprised of the two electric motors and a single joystick controller that controls the two electric motors as described below. In the second embodiment, the propulsion system includes the two electric propulsion motors, a single joystick controller, a pair of actuating motors for raising and lowering each of the electric motors and propellers into and out of the water, a control box that controls the action of the lifting actuators and a key pad on the joystick with a motor position switch. Thus, in the second embodiment, the control box functions include actuator controller for raising and lowering motors, a self-test function of the actuators, battery voltage measurement and a key pad display that provides an indication of where the electric motors are positioned relative to in or out of the water or in between and an indication of auto retraction in which the propulsion electric motors are raised at power shutdown.

In the second embodiment, the joystick controller includes a key pad that has a plurality of LED indicating lights, a cruise control button that can control the propulsion motors in cruise, which is explained below, a battery power indicating button that works in conjunction with the LED position indicating lights to give battery power consumption available and up and down switches for the actuating motors that are used to raise and lower the electric propulsion motors. The key pad and display that is installed on the joystick also includes an ambient light sensor for changing the light intensity of the indicating lights.

In the second embodiment that includes the control box, the control box interfaces the key pad and display and the actuators.

In the first embodiment, the joystick controller is connected by conductors to a power source such a twelve or twenty-four volt battery that supplies electrical power to a pair of digital electric motors. By activating the joystick controller, the user provides DC electric power input current pulses to the watercraft propulsion motors.

Each electric propulsion motor is mounted to the stem or the stem area of a watercraft. Each electric motor shaft can be rotated in a first direction to create forward speed using the propeller and in a second direction for reverse motion from the propeller.

The joystick controller, by controlling electrical power individually to each of the digital motors, can provide speed, direction and, using two motors, steering of the boat or watercraft in operation. The joystick controller can be suitably mounted in a convenient location on the watercraft for the operator to get the benefit of controlling the direction, speed and steering the boat.

The joystick controller accomplishes steering and speed control of the motors via electronic signaling. There is no mechanical link between the joystick controller and either of the electric motors used in the propulsion system.

The position of the vertical joystick handle relative to the center position of the joystick controller defines speed with deflection from the center position, steering by the angular position of the deflection relative to the joystick axis, and propulsion direction (forward or reverse) based upon which quadrant the joystick deflection is in and the angular position of that deflection.

One of the benefits of the joystick controller described herein is that the joystick actuating shaft returns to the center position by an internal mechanism when released. The center position represents a power "off" position for the motors. If the user or driver of the watercraft were to fall off the watercraft, the propulsion system will turn off because the joystick will mechanically return to the center zero position.

The joystick controller could include a cruise control button which allows the user or driver to lock in a specific speed and direction by momentarily pushing a cruise switch and then releasing the joystick handle so that the stick returns to the center position. Cruise control values can be cancelled by another depression of the cruise switch or by moving the joystick handle away from the center position. This feature allows for continuous operation without the need to provide continuous Joystick deflection.

In an alternate embodiment, the joystick handle can also include a key pad attached near the top of the joystick handle. In most trolling boats, for example, in addition to having the two electric propulsion motors, each propulsion motor has an actuator electric motor that allows the propulsion motor to be raised or lowered into and out of the water or any position in between full up and full down. The key pad provides an up/down switch for raising and lowering each actuator motor incrementally between a full up position and a full down position relative to the water. The electric propulsion motors can be deployed at any position between fully up and fully down which allows the user to optimize motor position for speed or for shallow running. The key pad also provides a visual indication of the relative position of the propulsion motors. Thus, using a key pad and visual indicators on the joystick handle, the user can control the up, down or in between position of the propulsion motors and visually observe a column of individual lights that indicate the position of both motors.

The LED indicator lights on the key pad also include a visual representation of the battery voltage level to show the voltage of the batteries when a battery switch is depressed. The key pad may include a cruise control switch to lock the propulsion motors in a specific controller voltage for speed and direction to allow the operator to release the joystick to the middle position (zero) without shutting off the system. Depressing the cruise control switch, once again turns off the cruise control.

The key pad display has two different visual indications that can be differentiated by the use of multicolor LEDs (light emitting diodes). The key pad has back lighting of the switch legends and logos which make them visible at night and includes an ambient light sensor which adjusts the brightness of the LED display depending on ambient light present. A safety feature could also be employed with the key pad system which requires the user to continuously press one of the key pad switches for a pre-determined amount of time before the propulsion motors can be turned on. This could prevent accidental activation of the system if something were to accidentally deflect the joystick. An additional motor lock out function can be used which prevents the propulsion motors from turning until they have been lowered to a certain minimal level relative to the water.

The joystick controller is comprised of a two axis joystick with proportional and liner operation which produces an X and Y voltage that corresponds to the joystick's shaft deflection. These X and Y voltages are measured with an analog to digital converter. The digitized X and Y values are then used to calculate the deflection from center. This is accomplished by calculating X*X (X squared), calculating Y*Y (Y squared), summing X squared and Y squared, and then calculating the square root of the sum. This value represents the speed vector generated from the joystick stick deflection. In some implementations, this speed vector is scaled. Steering is accomplished by controlling the relative thrust and direction of thrust between the two motors. Depending on the quadrant that the joystick's shaft deflection is located, one motor will be considered a reference motor while the other motor will be considered a steering motor. The reference motor will be set to a speed based upon the speed vector described above. The steering motor will be set to a speed based upon the speed vector multiplied by some coefficient. This coefficient is typically determined by using trigonometry functions sin, tangent, or cotangent of the joystick's angular deflection from the joystick axis although the use of other coefficients is quite possible. The direction of thrust for the vessel is determined by which hemisphere (Y axis) the joystick has been deflected. In some implementations, the direction of thrust for the vessel is further constrained to an angular region within a specific hemisphere. For the steering motor, the direction of thrust is determined by both the hemisphere that the joystick is deflected as well as the trigonometric coefficient.

It is an object of this invention to provide a controller for an electric propulsion system for watercraft that with a single manual control device can adjust direction, speed and steer a watercraft using two or more electric motors.

It is another object of this invention to provide an electric propulsion controller for two electric watercraft motors having propellers that upon manual release returns to a zero position shutting off the propulsion system for safety feature.

In accordance with these and other objects which will become apparent hereinafter, the instant invention will now be described with particular reference to the accompanying drawings.

PREFERRED EMBODIMENT OF THE INVENTION

Figure 1:
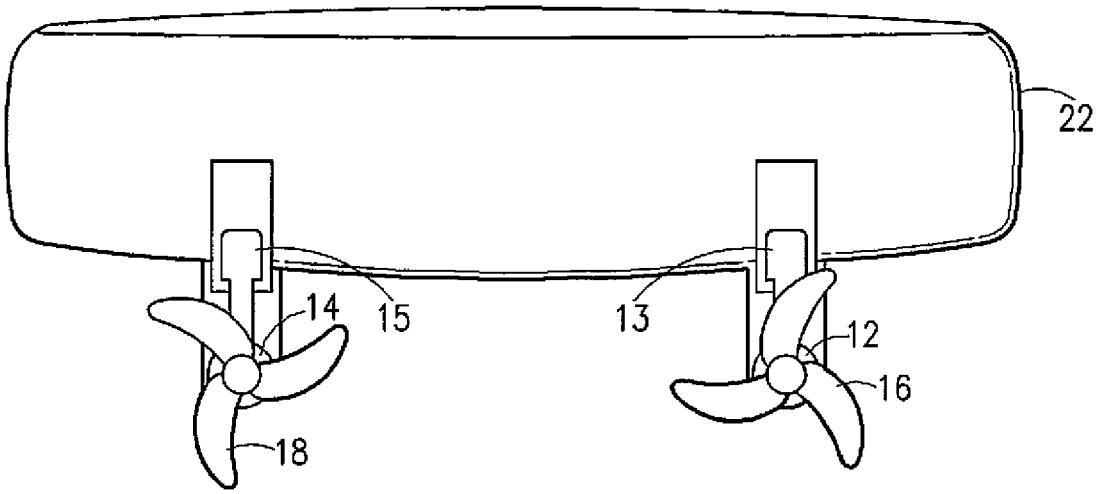
FIG. 1 shows an elevational view of the stern of a watercraft having the propulsion system disclosed herein.

Referring now to the drawings and, in particular to FIG. 1, the stem of a marine vehicle such as a boat stem 22 shows a pair of electric propulsion motors 12 and 14 mounted on the stem of a boat 22 each having a propeller 16 and 18. The propulsion system is comprised of two electric motors 12 and 14 that are controlled by a manual controller 10 (FIG. 2) that can be mounted somewhere in the boat 22. The controller in accordance with the system described herein does not require mechanical linkage but is a total electric control by wire of the propulsion system. With the use of a single controller, the steering, speed and direction of a boat 22 can be accomplished. Electric actuators 13 and 15 are used in a second embodiment to raise and lower propulsion motors 12 and 14 into and out of the water.

Figure 2:
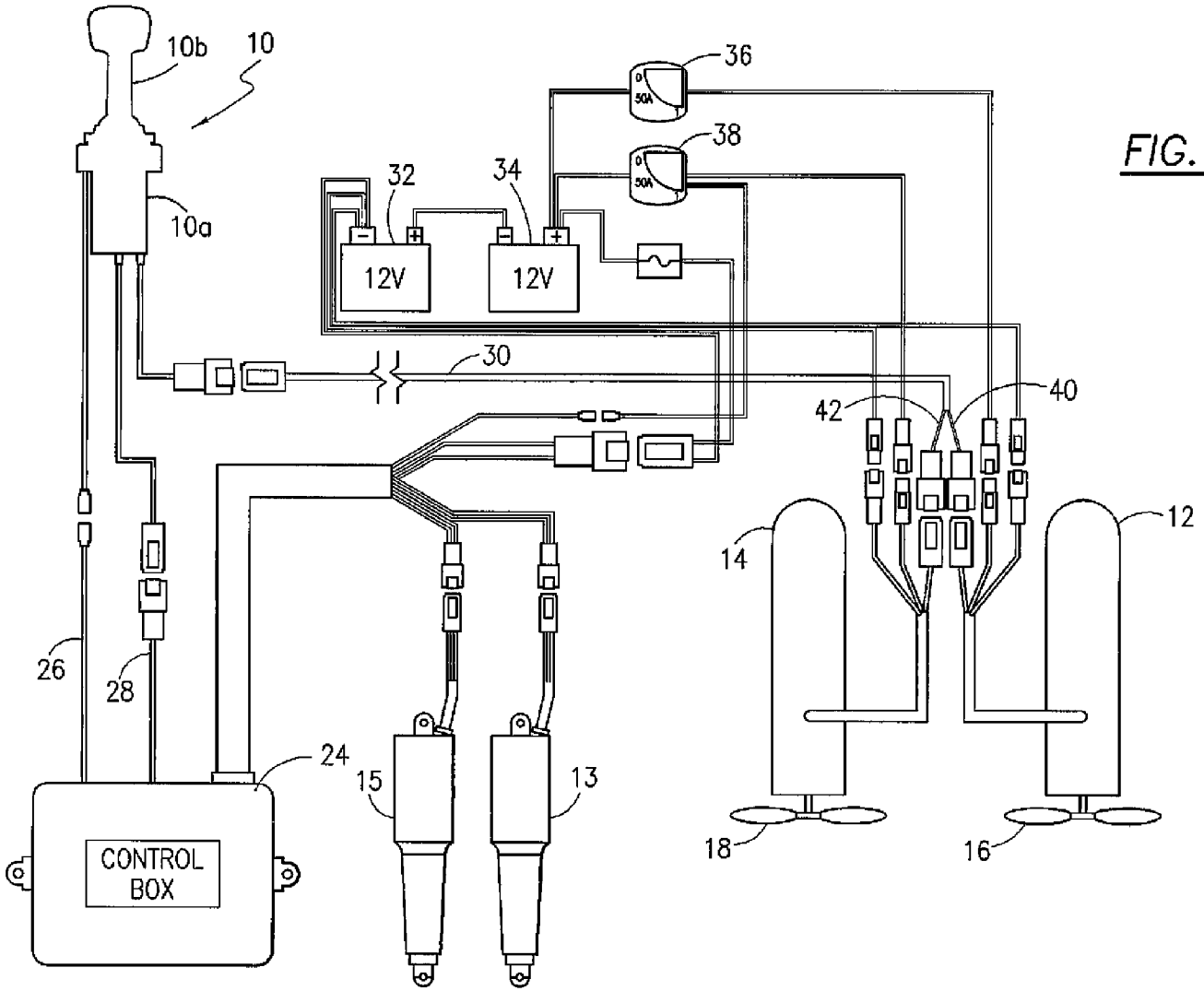
FIG. 2 shows the present controller schematically attached to a battery and a pair of electric digital motors having propellers is used with the present system.

Referring now to FIG. 2, the overall system (the second embodiment) including the actuators 13 and 15 is shown with the joystick controller 10 connected by wires 26 and 28 to a control box 24 that includes multiple signal outlet conductors. A pair of 12 volt batteries 32 and 34 is connected in series to the propulsion motors 12 and 14 through circuit breakers 36 and 38. The specific operation electrically of the joystick controller 10 has been described above. Movement (deflection) of the single stick controller 10 about its central point in an x, y axis arrangement causes different digital signals to be received by motor 12 and motor 14. Specifically, motor 12 and motor 14 can be driven into two directions, forward or reverse. This is accomplished by the proper digital signals from controller 10 that controls the direction and rotation of motor 12 and, thus, propeller 16. Similarly, motor 14 and propeller 18 can be controlled in a forward or reverse direction. In addition, digital signals control the RPM of motor 12 and the RPM of motor 14 for increasing the propulsion thrust or speed of each motor for increasing the speed of the boat being controlled. Steering is accomplished by controlling the relative thrust and direction of thrust between motor 12 and motor 14 which determine the overall steering of the marine vehicle that motors 12 and 14 are attached to. One motor is operated as a reference motor. As can be readily appreciated looking at FIG. 2, the controller 10, with a single control element, can adjust speed, steering and direction of propulsion with the single stick. Also, there are no mechanical connections between the motors and the controller 10 but are all electrical. The controller 10 and, specifically, the controller base 10*a* includes a controller board that provides for analog to digital conversion of the analog signals generated by the stick 10*b* and provides for creating the digital signals that are used to send the proper digital signals to each motor that results in the thrust to each motor, the steer of the boat by varying the thrust between the two motors, one of them being a reference motor at a reference speed and by changing the direction of each motor as was described above. The controller card in the controller 10 is used in both the first embodiment without the actuators for lifting the motors and the second embodiment that includes the key pad and the actuators.

The controller 10 includes a rigid, single element elongated shaft that is centrally attached at its base that provides the electronic signaling generated in base 10*a*.

With the system shown in FIG. 2, with the two motors 12 and 14 mounted on a boat or other watercraft, the watercraft can be controlled in its forward velocity or reverse velocity or steered so that the entire watercraft is turned left or right to any direction or heading desired. The forward and reverse speed of the boat can also be controlled by deflection of the stick 10*b* by the operator.

As shown in FIG. 2, the control box which is connected to the controller 10 and actuators 13 and 15 provide for lifting and lowering the propulsion motors 12 and 14 through the action of the electric actuating motors 13 and 15 so that using a switch mounted on a controller 10*b*, the propulsion motors 12 and 14 can be raised to a full up position, lowered to a full down position when the motors are in the water completely and to any intermediate position using the motor position switch on the joystick 10*b*. The power to the actuating motors 13 and 15 is controlled through control box 24. Actuators 13 and 15 act together so that each of the motors 12 and 14 is in the same relative position to each other and do not act independently. The control box also provides for retraction of the motors 12 and 14 from out of the water when certain conditions are met with regard to the power to the system.

Control box 24 also provides for controlling the LED lights that are described below that provide indications of the relative position of the motors 12 and 14 between full up and full down or somewhere in between and also provide for the amount of voltage available from the batteries which is described below.

Figure 3:
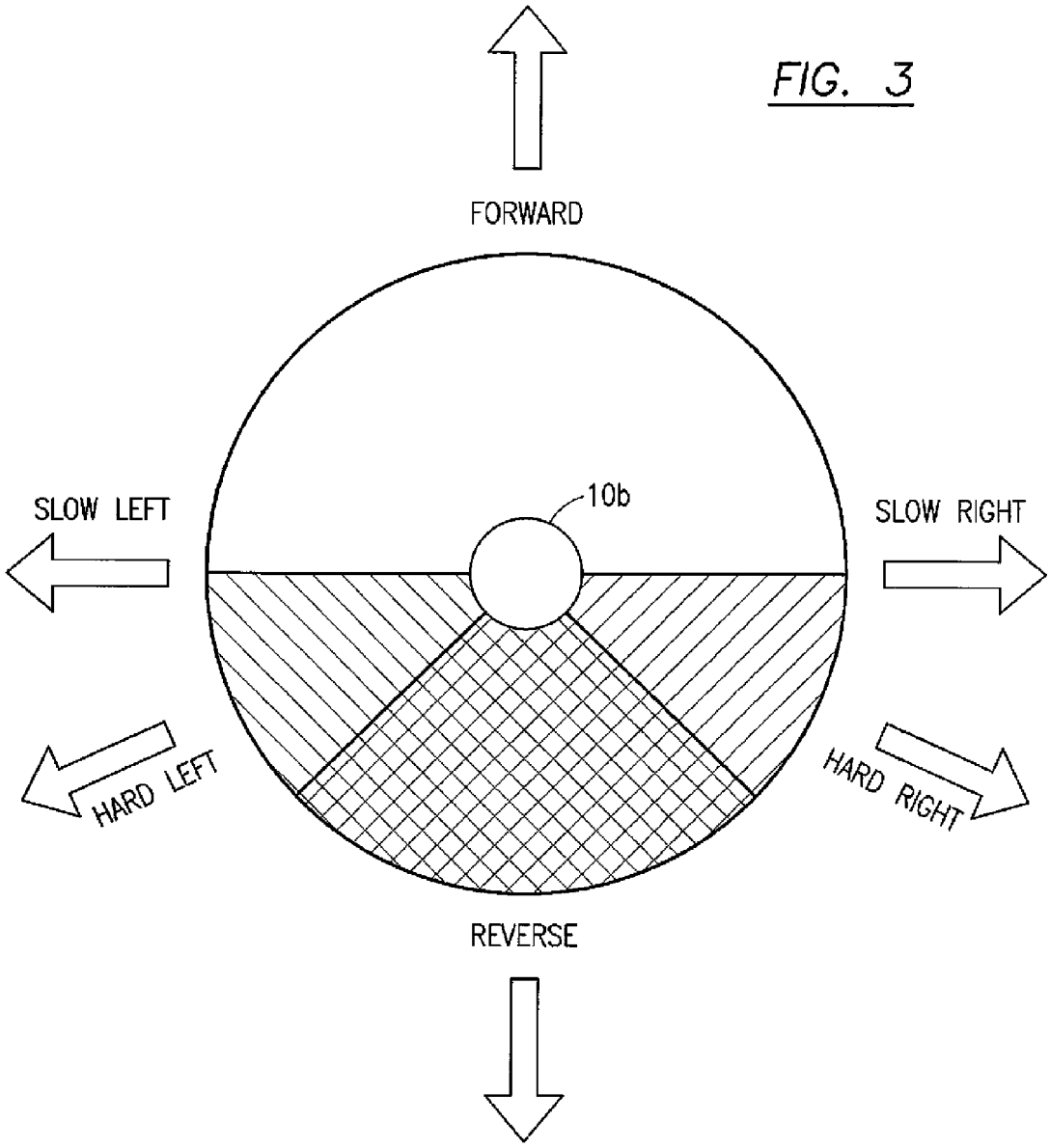
FIG. 3 is a deflection from center diagram showing the joystick shaft deflection axes control for steering viewed from above in circular quadrants relative to the joystick shaft deflection from a center zero position.

Referring now to FIG. 3, a joystick deflection diagram for signal generation is shown. The steering indications are for the watercraft. The shaft 10*b* is represented by the center circle and, in the off position (zero speed), the shaft is centered vertically. Deflecting the shaft 10*b* upwardly (in the forward direction) causes the watercraft to go forward. Both motors propel the watercraft in a forward direction. Likewise, pulling straight back on the shaft 10*b* in the bottom quadrant as shown will result in both motors being in a reverse mode and the watercraft would go backwards.

Steering the watercraft can be done by controlling the thrust of the two motors 12 and 14 even in opposite directions to accomplish steering. As shown in FIG. 3, pushing the shaft 10*b* to the left direction (270 degree angle) would be a slow left while pushing the shaft 10*b* to the right (90 degree angle) would be a slow right. In order to do a hard left, the right engine goes forward and the left engine goes backward, the stick is moved into the hard left quadrant. Likewise, for a hard right, the stick would be moved into the shaded area shown which causes the boat motors 12 and 14 to have different thrust vectors. The speed of the watercraft will also be controlled by the amount of joystick deflection from the center position.

The steering pattern shown in FIG. 3 is selected to optimize battery life between charges. Different steering patterns can be selected for different objectives, such as maneuverability or reverse maneuverability.

The control shaft 10*b* can also allow for the elimination of a propulsion system kill switch or commonly referred to as a "dead man" switch. In this particular implementation, there would not be a cruise control mode. The joystick naturally returns by spring tension or otherwise to the center position (zero speed) when released by an operator so that shaft 10*b* is vertical in the center which represents off for the electric motors 12 and 14. Thus, if the operator were to fall off of the watercraft, the controller 10 out put will go to zero speed and both propulsion motors are off.

In either the first or second embodiment, the system could include a cruise control switch. This would allow an operator to lock in a specific speed, steering direction and propulsion direction by momentarily depressing a cruise switch on the controller 10 and then releasing the joystick handle so that the stick 10*b* returns to the center position while both motors 12 and 14 maintain their specific thrusts. The cruise control values can be cancelled by another depression of the cruise control switch or by moving the joystick handle away from the center position. This specific implementation will allow for continuous operation without the need for continuous joystick deflection. In the second embodiment with the key pad on the joystick, the cruise control signals are passed through the control box 24.

Figure 4:
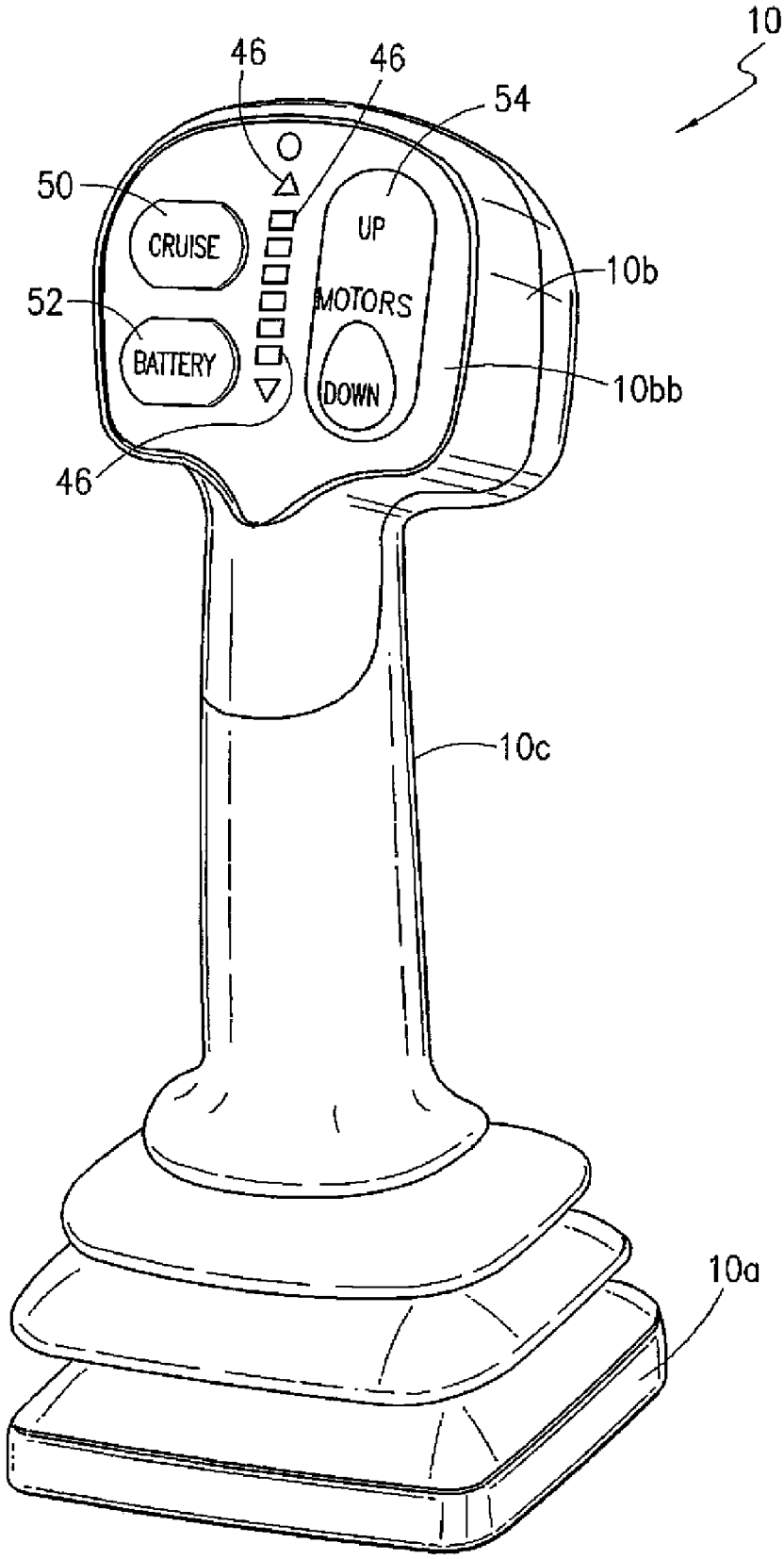
FIG. 4 is a perspective front view of the manual joystick controller and key pad.

Referring now to FIG. 4, the controller 10 is shown that includes a central elongated rigid vertical shaft 10*c*. The shaft 10*c* or upper knob 10*b* can be grasped by the hand for manual control.

The key pad 10*bb* deposed at the top 10*b* of the joystick has a plurality of LED lights 46 arranged vertically, a cruse control push button 50, a battery control push button 52 and a motor position switch 54 to allow both of the propulsion motors to be positioned up or down relative to the boat stem.

The LED lights 46 are arranged vertically to indicate motor position up and down or positions in between. When the battery switch 52 is activated, the lights can indicate the amount of voltage in the batteries by various colors of red or green or a mixing of red and greed to have various hues of orange.

The joystick controller 10 is an off the shelf controller that has the x, y voltage electronic system that has been described above as to its operation. In addition, however, to the controller 10, a control card is mounted in the base 10*a* that converts the joystick analog signals to digital signals to control motors 12 and 14 as described above.

With the use of the present controller and control card, an operator can easily control a watercraft in speed, steering and direction of propulsion with a single stick mechanism. The system can also include a cruise control implementation or provide for its own kill switch to protect the operator. The system also provides for controlling a pair of propulsion electric motors without any mechanical connections. Visual displays of motor position and battery voltage are provided.

The joystick controller has been shown and described herein in what is considered to be the most practical and preferred embodiment. It is recognized, however, that departures may be made therefrom within the scope of the invention and that obvious modifications will occur to a person skilled in the art.

What is claimed is:

1. An electric propulsion system for a watercraft comprising:

an electric power source;

a remote manual electric motor control mechanism, connected to said power source, having a single control shaft movable to any radial direction for three hundred and sixty degrees and controller circuitry, said controller circuitry generating a digital control signal in response to the movement of the control shaft;

said digital control signal carries an embedded control value that indicates the angular direction and the relative distance from the center neutral position of any deflection of the control shaft;

at least two electric motors, each having a propeller mountable to a watercraft hull and being connected to said control mechanism and power source wherein a first electric motors with a first propeller is mounted on the port side of the watercraft hull and a second electric motors with a second propeller is mounted on the starboard side of the watercraft hull;

said digital control signal causing the first electric motor to rotate the first propeller and the second electric motor to rotate the second propeller, wherein the first electric motor rotates the first propeller in a forward or reverse direction and at a specific speed determined by the control value, the second electric motor rotates the second propeller in a forward or reverse direction and at a specific speed, determined by the control value; and the remote manual electric motor control mechanism electrically controlling the velocity and heading of the watercraft by the control value to every motor, wherein said control value causes the first motor and the second motor rotate the first propeller and the second propeller, respectively in the same direction at the same speed, in the same direction at different speeds, in opposite directions at the same speed, or in opposite directions at different speeds.

2. The electric, propulsion system for watercraft described in claim 1, wherein the remote manual electric motor control mechanism comprises a user operated joystick, said joystick controlling movement of the watercraft through radial movement of the control shaft relative to a center neutral position of the remote manual electric motor control mechanism's four quadrant mount, and the control shaft positioned in said center neutral position causing the first electric motor and the second electric motor to provide no thrust to the first propellers and the second propeller, respectively.

3. The electric propulsion system for watercraft described in claim 2, wherein the control shaft returns to the center neutral position when a user applied manual force is removed.

4. The electric propulsion system for watercraft described in claim 2, wherein the remote manual control mechanism further comprises a cruise control device, said cruise control device being manually engaged and disengaged from said remote manual electric motor control mechanism to maintain a given thrust and direction.

5. An electric propulsion system for watercraft comprising:

a power source;

a first electric motor and a second electric motor connected to said power source;

a first propellers connected to said first electric motor and a second propeller connected to said second electric motor;

a manual control mechanism connected to said power source and said first electric motor and said second electric motor;

said manual control mechanism providing digital signals to control the speed and direction of a watercraft;

the manual control mechanism comprising an analog to digital signal generator connected to said control mechanism and said first electric motor and said second electric motor and a user operated joystick to control the speed and direction of the watercraft, said joystick controlling movement of the watercraft through user applied radial and angular movement of the joystick in any direction for three hundred and sixty degrees relative to a center neutral position of the joystick within a four quadrant mount, said center neutral position providing no thrust to the propellers; and each radial and angular position of said joystick away from the center neutral position generates an electrical vector signal that manipulates the speed and heading of the watercraft by independently controlling the rotational direction and the amount of thrust that first electric motor provides to the first propeller and the rotational direction and the amount of thrust that second electric motor provides to the second propeller.

6. The electric propulsion system for watercraft described in claim 5, wherein the joystick automatically returns to the center neutral position and causes the removal of thrust to the first propeller and the second propeller when user applied movement to the joystick terminates.

7. The electric propulsion system for watercraft described in claim 5, wherein the remote manual control mechanism further comprises a cruise control device, said cruise control device is manually engaged and disengaged.

8. An electric propulsion system for a watercraft that includes a first electric motor with a propeller and a second electric motor with a propeller, said first and second motors being coordinated in operation to propel the watercraft in a forward direction, in the reverse direction, and to turn the watercraft in a slow left, hard left, slow right and hard right, through the manual operation of a manual controller comprising:

an electric power source;

remote manual control mechanism having a control shaft movable radially from a center off position to any radial direction for 360° from said central neutral point for generating electrical motor control signals, said remote manual control mechanism connected to said electric power source;

first electric motor having a first propeller connected thereto and a second electric motor having a second propeller connected thereto, said first and second electric motors being mountable to a watercraft, said first electric motor with said first propeller being mountable on the port side of a watercraft and said second electric motor with a second propeller being mountable on the starboard side of a watercraft;

plurality of conductor wires interconnecting the power source, the manual control mechanism, and said first and second electric motors;

said remote manual control mechanism having a 180 degree semi-circular shaft deflection area for manual shaft movement that activates said first and second motors together in the same direction and same motor speeds, said first and second motor speeds representative of the deflection distance from said shaft off neutral point;

said manual control mechanism having a second shaft deflection area that activates said first motor and said second motor together in the reverse direction to provide reverse thrust for a watercraft; and said remote manual control mechanism shaft having left deflection area in which the first and second motors are activated together in opposite directions at different speeds, and said manual control mechanism shaft having a right deflection area that operates the first and second motors together in opposite directions at different speeds to each other for aiding in turning a watercraft slow left, hard left, slow right and hard right dependent on the position of said shaft in said left or right deflection areas.

* * * * *